US005856289A

United States Patent [19]

Kennedy

[11] Patent Number: 5,856,289

[45] Date of Patent: Jan. 5, 1999

[54] HARD SURFACE CLEANER WITH D-LIMONENE, ETHYLENE SLYCOLBUTYL ETHER, NONYLPHENOL ETHOXYLATE, AND PHOSPHATE

[76] Inventor: Michael Stephen Kennedy, 8500 Bubbling Springs Dr., Baldwinsville, N.Y. 13027

[21] Appl. No.: 759,841

[22] Filed: Dec. 2, 1996

[51] Int. Cl.[6] ..... C11D 3/18; C11D 7/24; C11D 1/72; B08B 3/08

[52] U.S. Cl. ..... 510/365; 510/239; 510/238; 510/421; 510/422; 510/463; 510/417; 510/506; 134/40; 134/42; 134/39

[58] Field of Search ..... 510/365, 239, 510/238, 421, 422, 463, 251, 417, 506; 134/40, 42, 39

[56] References Cited

U.S. PATENT DOCUMENTS

| | | | |
|---|---|---|---|
| 5,082,584 | 1/1992 | Loth et al. | 252/122 |
| 5,156,687 | 10/1992 | Ushio et al. | 134/40 |
| 5,340,493 | 8/1994 | Principato | 252/462 |
| 5,356,482 | 10/1994 | Mehta et al. | 134/22.1 |
| 5,523,025 | 6/1996 | Erilli | 252/550 |
| 5,532,024 | 7/1996 | Arndt et al. | 427/327 |
| 5,580,848 | 12/1996 | Drapier | 510/417 |
| 5,604,195 | 2/1997 | Misselyn et al. | 510/400 |

FOREIGN PATENT DOCUMENTS 61085498 5/1986 Japan .

OTHER PUBLICATIONS

Todhunter, John A., "Evaluation of Whether or Not Simple Green can be considered as non–toxic, biodegradable, or environmentally safe," Science Regulatory Services International, pp. 1, 24, 34, and 37, Apr. 1992.

American Chemical Society, Registry nos. 5989–27–5, 111–76–2, 27986–36–3, and 9016–45–9, Mar. 1997.

*Primary Examiner*—Douglas J. McGinty

[57] ABSTRACT

Invention is based upon the use of a unique chemical blend for an environmentally safe cleaner/degreaser. This chemical blend comprises d-limonene and SIMPLE GREEN. Both d-limonene and SIMPLE GREEN have been shown to be effective as cleaners and degreasers, but their use in combination has been shown to be synergistic. The components of the synergistic combinations show rapid biodegradation rates (>90% in 30 days), with minimal environmental impact. The chemical blend has a pH of 7.0 plus or minus 0.2 and does not entail special handling procedures or discharge requirements. Also, the use of my invention will not cause any adverse effects to the hard surfaces being cleaned, in comparison to other cleaner/degreasers that utilize a pH near 9.0.

4 Claims, No Drawings

HARD SURFACE CLEANER WITH D-LIMONENE, ETHYLENE SLYCOLBUTYL ETHER, NONYLPHENOL ETHOXYLATE, AND PHOSPHATE

BACKGROUND OF THE INVENTION

On the industrial marketplace, the current state of the art for cleaners and degreasers usually involves 1 sometimes 2 of the following:

Trichloroethylene
Methylene chloride
Phenol
Ethanol 2-amino
Ethylene glycol monobutyl ethyl
Polyoxyethylene decyl phosphate.

These agents are usually mixed with sodium hydroxide to bring the pH above 9.0 to facilitate cleaning. While these agents may be effective as cleaners or degreasers, they require special handling procedures and/or special discharge requirements. Some of these agents have been pointed out to have carcinogenic qualities. Others like phenol, for example, have maximum allowable discharge limits as set by the EPA for the industrial user.

As the EPA and OSHA look closer at the chemical products being used in the industrial workplace, my invention can fulfill a need by providing an effective cleaner/degreaser with minimal environmental impact. The use of my invention does not entail special handling procedures or discharge requirements. Also, it can be considered as an innocuous agent to the end user.

DESCRIPTION OF INVENTION

The products being used in the industrial workplace for cleaning and degreasing have a high pH of greater than or equal to 9.0 and contain dangerous even carcinogenic compounds. There is a need for a product that could be an effective cleaner/degreaser without adverse effects to the user or the environment.

d-limonene is widely known as a general cleaner, usually in the retail marketplace. Past experience with d-limonene has shown it to be safe to use. Even though it can be dangerous when handled in its concentrated form, >95%, the highest concentration of d-limonene in my invention is 90% and the dangers of flash point, e.g., are diminished. The first steps toward an environmentally friendly cleaner/degreaser were to use dilutions of d-limonene and water. According to manufacturer's recommended dosage, d-limonene is to be used at concentrations of 15%–25% d-limonene in water for the treatment of oily hard surfaces. However, field experience showed that these concentrations were not effective in the industrial workplace. Higher concentrations were not tried because of the concern for environmental hazards.

Experience with the product SIMPLE GREEN, is as an overall cleaner/degreaser. The majority of the use of SIMPLE GREEN has been on the retail market. All of the ingredients of SIMPLE GREEN are considered environmentally safe. The components of SIMPLE GREEN are, by weight, about 5.8% glycol ether ethylene glycol monobutyl ether, sold commercially as BUTYL CELLOSOLVE, about 3.75% nonylphenol ethoxylate, about 1.5% tetrapotassium pyrophosphate, and about 88.95% water. The only ingredient of SIMPLE GREEN with established exposure limits is BUTYL CELLOSOLVE; the OSHA PEL and ACGIH TLV is 25 ppm skin. BUTYL CELLOSOLVE as a part of the chemical category of glycol ethers, is regulated by the Emergency Planning and Community Right to Know Act, and therefore a reporting requirement exists. All other ingredients of SIMPLE GREEN are not considered so dangerous as to require listing by Federal OSHA, NTP, or LARC.

Steps were taken to use dilutions of SIMPLE GREEN and water in the industrial workplace for the treatment of oily hard surfaces. According to manufacturer's recommended dosage, concentrations of 50% water/50% SIMPLE GREEN, to full strength can be used. In the industrial workplace, field experience showed these concentrations to be ineffective, particularly in the cleaning and treatment of oily hard surfaces.

Since neither d-limonene alone nor SIMPLE GREEN alone was effective as a cleaner/degreaser in the industrial workplace, product combinations were attempted especially since SIMPLE GREEN had been ineffective in the treatment of oily surfaces. An initial combination of 90% of SIMPLE GREEN, 10% d-limonene was attempted and a milky paste-like substance was formed. When this substance was physically applied to a dirty oily surface effective cleaning was accomplished. The next combination attempted was 20% SIMPLE GREEN, 15% d-limonene, 65% water was tried. With this combination, a thick milky suspension was formed that was impossible to use via a conventional spray bottle application. When physically applied to a dirty, oily surface it was effective as a cleaner of hard surfaces. The next solution strength of 20% SIMPLE GREEN, 10% d-limonene, 70% water still formed a milky suspension impossible to use via spray bottle. This combination was effective as both a cleaner and degreaser. A solution of 20% SIMPLE GREEN, 5% d-limonene, 75% water formed a light green solution at room temperature that was possible to be used with a spray bottle. It produced some foaming upon application, yet was effective as a cleaner and degreaser. Experience with SIMPLE GREEN has shown that dilution with water will cause foaming, sometimes excessively, so a solution strength of 10% SIMPLE GREEN, 5% d-limonene, 85% water was tried. This solution combination resulted in a homogenous mixture that was effective as a cleaner/degreaser, did not foam, and was easy to apply with a conventional spray bottle. This would classify as a preferred embodiment of my invention.

EXAMPLE

Five 2"×6" vinyl tile strips of white linoleum were dipped into a basin of a homogenous mixture of oil/grease and industrial floor soil. The industrial floor soil was collected from the wastewater treatment area of a industrial commerical laundry specializing in cleaning of heavily soiled industrial uniforms. The amount of oil/grease in the basin was around 1000 ppm as determined by EPA method 413.1. The tile strips were then suspended from a horizontal support and allowed to remain for 30 minutes. This allowed for any excess to run off into a catch trough.

All tiles initially exhibited a dark brown-black oily surface. In the industrial workplace, nearly all cleaner/degreasers are applied via spray bottle or injected via mechanical spray. The treated tiles were each sprayed with 1.5 ounces of treatment solution. All tiles were wiped with a clean white cloth until it was determined that no further wiping would result in any additional cleaning, about 2–3 minutes. The treated tiles were then rated on the percent of improvement of surface area cleaned as compared to control. For example, each tile comprises 12 square inches of surface area. A treated tile to obtain a 50% rating would need to clean 6 square inches of surface area, a 75% rating would entail 9 square inches of surface area cleaned, etc.

The following expresses the actual quantities of cleaning agents used:

| | |
|---|---|
| TILE A | 1.5 ounces ofwater |
| TILE B | 1.5 ounces of SIMPLE GREEN-50% water, or 0.75 ounces SIMPLE GREEN |
| TILE C | 1.5 ounces of 25% d-limonene-75% water or 0.375 ounces of d-limonene |
| TILE D | 1.5 ounces of my invention-10% SIMPLE GREEN, 5% d-limonene, 85% water 0.15 ounces of SIMPLE GREEN, 0.075 ounces of d-limonene |

The percent of improvement over control, expressed as percent of improvement in surface area cleaned was:

| | |
|---|---|
| TILE A | <10% |
| TILE B | 60% |
| TILE C | 75% |
| TILE D | >99% |

The amount of surface area cleaned was not only higher with my invention, but this was accomplished with lower treatment dosages compared to TILE B or TILE C. This was an unanticipated result. Furthermore:

| | | |
|---|---|---|
| TILE B | 0.75 ounces SIMPLE GREEN | 60% cleaned |
| TILE C | 0.375 ounces d-limonene | 75% cleaned |
| TILE D | 0.15 ounces SIMPLE GREEN 0.075 ounces d-limonene | >99% cleaned |

The treatment dosages of my invention are only 20% of TILE B and TILE C, yet the cleaning efficiency increased to >99%. This would demonstrate a synergistic effect between d-limonene and SIMPLE GREEN over this concentration range.

I claim:

1. An aqueous composition for cleaning hard surfaces comprising a mixture of, by weight:

a. about 5% to about 25% d-limonene; and b. about 10% to about 90% cleaner/degreaser, said cleaner/degreaser containing about 5.8% ethylene glycol monobutyl ether, about 3.75% nonylphenol ethoxylate, about 1.5% tetrapotassium pyrophosphate, and about 88.95% water.

2. The aqueous composition of claim 1, to which additional water has been added in an amount of up to about 90% by weight.

3. A process for cleaning at least one of oil, grease, or soil from a hard surface comprising the steps of contacting said hard surface with the aqueous composition of claim 1 and removing said at least one of oil, grease, or soil from said hard surface.

4. A process for cleaning at least one of oil, grease, or soil from a hard surface comprising the steps of contacting said hard surface with the aqueous composition of claim 2 and removing said at least one of oil, grease, or soil from said hard surface.

* * * * *

UNITED STATES PATENT AND TRADEMARK OFFICE

CERTIFICATE OF CORRECTION

PATENT NO. : 5,856,289

DATED : 1/5/99

INVENTOR(S) : Michael Stephen Kennedy

It is certified that error appears in the above-indentified patent and that said Letters Patent is hereby corrected as shown below:

On title page, item [54] and col. 1,

In The Title:

Second line, third word, change "Slycolbutyl" to --Glycolbutyl--.

Signed and Sealed this

Twenty-seventh Day of July, 1999

*Attest:*

Q. TODD DICKINSON

*Attesting Officer*

*Acting Commissioner of Patents and Trademarks*